US007434278B2

(12) United States Patent
White et al.

(10) Patent No.: US 7,434,278 B2
(45) Date of Patent: Oct. 14, 2008

(54) APPARATUS FOR PATIENT MOBILITY

(76) Inventors: Elizabeth Ann White, 150 N. 600 East, American Fork, UT (US) 84003; Michael Wawrzynowski, 415 Herondo St., Apt. 132, Hermosa Beach, CA (US) 90254

( * ) Notice: Subject to any disclaimer, the term of this patent is extended or adjusted under 35 U.S.C. 154(b) by 8 days.

(21) Appl. No.: 11/170,605

(22) Filed: Jun. 29, 2005

(65) Prior Publication Data

US 2007/0000049 A1 Jan. 4, 2007

(51) Int. Cl.
*A61G 7/14* (2006.01)

(52) U.S. Cl. ..... 5/81.1 R; 5/81.1 HS; 5/83.1; 5/86.1

(58) Field of Classification Search ..... 5/81.1 R, 5/81.1 HS, 83.1–89.1
See application file for complete search history.

(56) References Cited

U.S. PATENT DOCUMENTS 1,082,177 A * 12/1913 Skeffington ..... 5/88.1
1,098,477 A 6/1914 Cashman
1,528,835 A 3/1925 McCullough
2,688,410 A 9/1954 Nelson
2,792,945 A 5/1957 Brenny
2,809,381 A * 10/1957 Colaner, Sr. ..... 5/87.1
4,887,325 A 12/1989 Tesch
5,005,233 A * 4/1991 Toivio et al. ..... 5/83.1
5,161,267 A 11/1992 Smith
5,181,289 A 1/1993 Kassai
5,210,887 A 5/1993 Kershaw
5,274,862 A 1/1994 Palmer, Jr.
5,333,334 A 8/1994 Kassal
5,406,658 A * 4/1995 Olkkonen et al. ..... 5/83.1
5,487,195 A 1/1996 Ray
5,499,408 A 3/1996 Nix
5,524,304 A 6/1996 Shutes
5,544,371 A 8/1996 Fuller
5,673,443 A 10/1997 Marmour
5,737,781 A 4/1998 Votel
5,890,238 A 4/1999 Votel
5,901,388 A 5/1999 Cowan
5,937,456 A 8/1999 Norris
6,035,465 A 3/2000 Rogozinski
6,049,923 A 4/2000 Ochiai
6,496,991 B1 * 12/2002 Votel ..... 5/81.1 HS
6,662,388 B2 * 12/2003 Friel et al. ..... 5/86.1
6,668,396 B2 12/2003 Wei
6,728,979 B1 * 5/2004 Robert ..... 5/81.1 R
6,834,402 B2 * 12/2004 Hanson et al. ..... 5/81.1 R
6,857,144 B1 2/2005 Huang
7,003,819 B2 * 2/2006 Weigand ..... 5/81.1 HS

* cited by examiner

*Primary Examiner*—Michael Trettel
(74) *Attorney, Agent, or Firm*—Bateman IP Law Group; F. Chad Copier

(57) ABSTRACT

An apparatus for repositioning bedridden patients with: a base, vertical and horizontal movements, and lifting portion; telescoping legs extending outward from the base with wheels affixed to each leg; detachable clamps affixed to each leg and capable of removeably attaching to a bed; the horizontal movement containing a roller and belts actuated by a gear and crank assembly coupled to the vertical movement portion; the vertical movement having two lifting units with first and second pistons coupled to the inside of each of the units and a hydraulic pump and controller for the actuation of the hydraulic pump and the upward and downward movement of the pistons; the lifting portion comprising a telescoping lifting arm with a lead screw and a crank for extending or retracting said lifting arm and with a lateral movement portion coupled to the top of the vertical movement and the lifting portion.

17 Claims, 10 Drawing Sheets

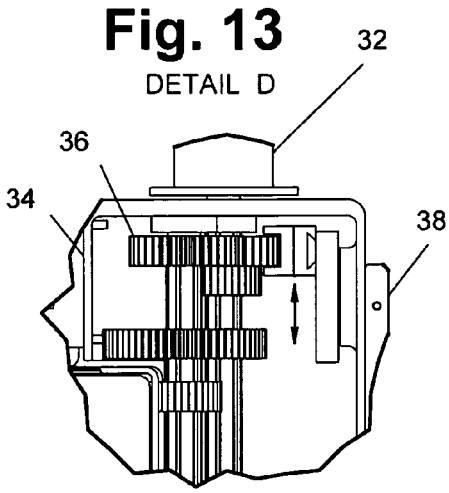
Fig. 13
DETAIL D
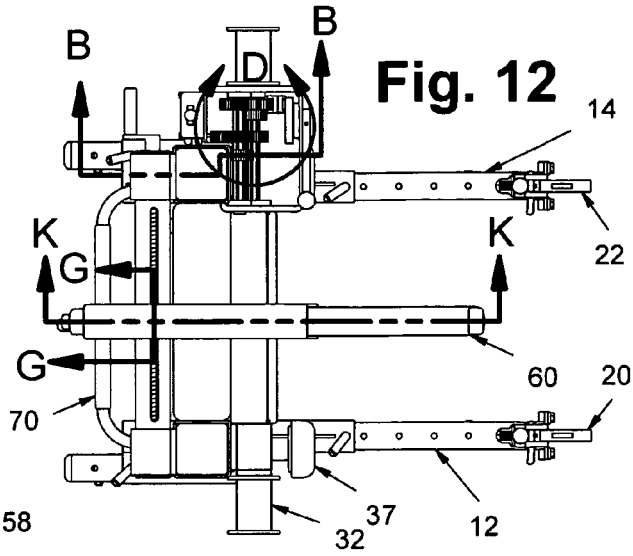
Fig. 12
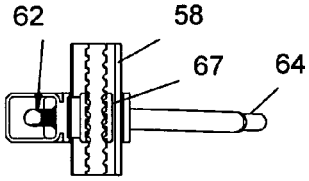
Fig. 12a
SECTION G-G
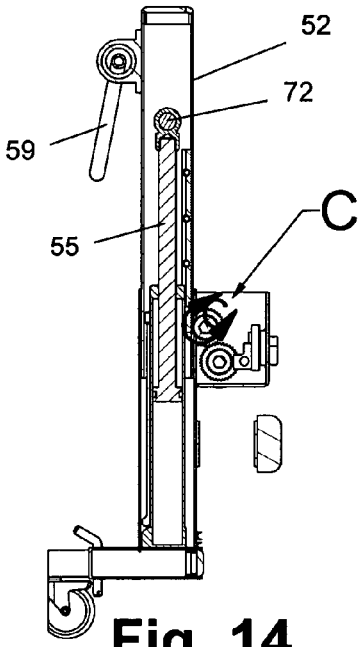
Fig. 14
SECTION B-B
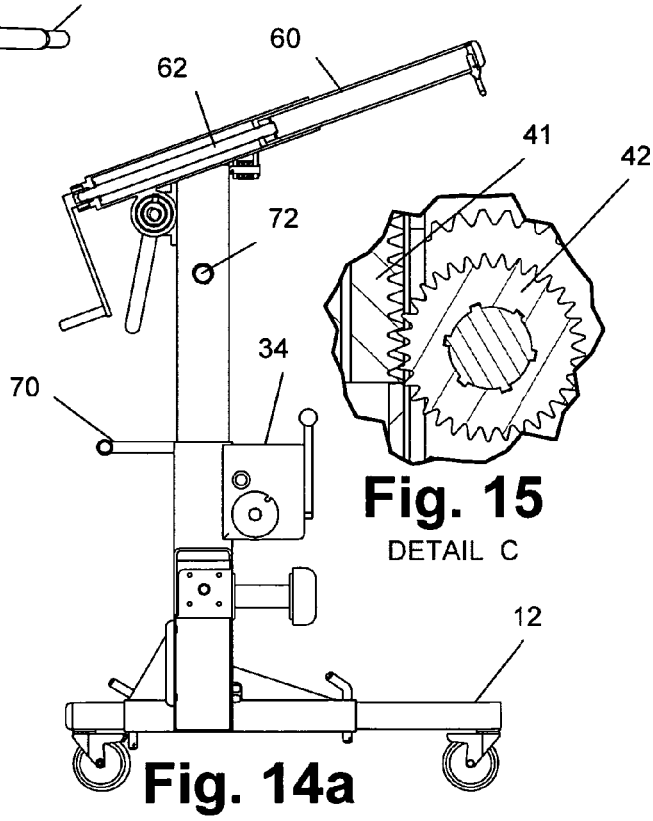
Fig. 15
DETAIL C
Fig. 14a
SECTION K-K

DETAIL A

APPARATUS FOR PATIENT MOBILITY

BACKGROUND OF THE INVENTION

1. Field of the Invention

The present invention relates to an apparatus for assisting a single caregiver when rotating, repositioning, lifting, or transferring a completely or partially physically disable patient without compromising the health or well being of either the patient or caregiver. More particularly, the apparatus comprises a single unit possessing a hydraulic lift means for vertical movement of a patient to effectuate rollovers and linen changes, a motorized winch means for horizontal repositioning or transference of patients between beds, gurneys or other patient support mechanisms, and a means for removeably securing the apparatus to a hospital bed while in use. Further, the present invention relates to an apparatus that can pull a patient laterally away from the bed rail through the use of a lifting arm positioned over a patient in a bed.

2. Description of Related Prior Art

Immobility of a patient contributes greatly to the deterioration of patient health. Immobile patients are prone to bedsores and pneumonia. A bedsore can take months or years to heal depending on the severity and location of the sore. Pneumonia occurs in immobile patients because secretions pool in the lungs fostering bacterial growth. Generally side-to-side turns of such patients, approximately every two hours, can prevent many occurrences of bedsores and pneumonia. Additionally, side-to-side turns are necessary to accomplish examinations of the patient. However, turns of this nature are generally the responsibility of hospital nurses, orderlies, or other staff in similar types of facilities.

Additionally, patients require the head of the bed to be raised in order to facilitate breathing and increase comfort. As a result of this incline, patients tend to slide toward the foot of the bed, impeding a patient's normal breathing and digestive functions and resulting in patient discomfort.

When a patient is obese or larger than the staff member, the force required to properly reposition the patient is considerable. Consequently, multiple staff members are required to reposition the patient manually. Moreover, if additional staff members are unavailable, the lone staff member is susceptible to injuries while attempting to reposition the patient without either mechanical assistance or, additional staff labor.

Back injury is a common work injury of nurses and hospital staff generally as a result of moving overweight, obese or patients who are significantly larger than the staff member. The act of turning a patient from side to side precludes proper body mechanics for lifting. In addition, obesity in the United States is increasing in marked amounts. Patient weight increases will only exacerbate the rate of back injuries among nurses, and increase the number of workers compensation claims filed as a result of such injuries as well as reduce the number of able body hospital staff. Consequently, assistance is necessarily required to accomplish necessary patient movement as well as protect hospital staff members against injury proximately resulting from patient repositioning, turning and transference.

Moreover, the task of patient repositioning, turning and transference is labor intensive and time consuming. Generally, patient movement requires at least two staff members. Generally nurses are female and significantly smaller in stature and weight then the patients they are assigned to care for. Furthermore, hospitals and skilled nursing facilities are homes to patients weighing in excess of 250 pounds. Consequently, at least three staff members are required to turn, reposition or transfer a patient of this magnitude. With the increase of nursing and staffing shortages, it is frequently impossible to gather enough staff members to move a large or oversized patient. Thus, either patient care suffers or the risk of injury to staff members is greatly increased.

Therefore a need exists for a multifunctional, yet simple to operate, patient mobility apparatus. Such an apparatus must be operational by one staff member without compromising patient safety and staff member safety.

The apparatus must be easy to install and operate, as well as not consume scarce space in hospital or skilled nursing facility. The apparatus must not compromise patient safety when effectuating the tasks of patient repositioning, turning, or transference.

The relevant art to this application does not disclose a device which permits a care giver to accomplish all the tasks accomplished by this apparatus for patient mobility, i.e, patient repositioning including: patient lifting, turning, and transference. At best, the relevant art allows a caregiver to accomplish two out of the four functions accomplished by the preferred embodiment of the present invention. Furthermore, the relevant art in this field are terribly expensive and cumbersome to use and install.

SUMMARY OF THE INVENTION

Accordingly, one object of the present invention is to provide an apparatus capable of being operated by one person in order to reposition a patient longitudinally in a bed, reposition a patient laterally within the bed, turning a patient on their side, lifting a patient, or transferring a patient from gurney to gurney, or gurney to bed.

A second object of the invention is an apparatus that easily integrates with standard hospital beds during its usage, and easily removes thereafter.

A third object of the invention is to provide an apparatus which repositions, turns, lifts or transfers a patient without injuring either the patient or staff member.

A fourth object of the invention is to provide an apparatus that does not consume precious space in skilled care facilities, hospitals or patient homes, and is easily stored when not in service.

A fifth object of the invention is to provide an apparatus which is inexpensive to produce and thus easily purchased by medical care facilities and family members faced with caring for immobile loved-ones in their home.

A sixth object of the invention is to reposition a patient to facilitate normal respiratory and digestive function.

An eighth object of the invention is to reduce patient feelings of patient isolation because the apparatus is less obtrusive then the prior art.

To achieve these and other advantages and in accordance with the purpose of the invention, as embodied and broadly described herein, the invention provides an apparatus for safely and effectively repositioning, turning, lifting or transferring immobile bed ridden patients.

BRIEF DESCRIPTION OF THE DRAWINGS

FIG. 12 is an overhead view of the apparatus with the top of roller gear box open.

FIG. 13 is an enlargement of Area D on FIG. 12 depicting the rack and pinion gears for the roller.

FIG. 14 is a cross section view of the apparatus along lines B-B in FIG. 12 exposing hydraulic mechanism for raising and lowering the vertical patient movement lift.

FIG. 15 is an enlargement of Area C on FIG. 14 depicting the gears to raise and lower the vertical patient movement lift.

DETAILED DESCRIPTION OF THE DRAWINGS AND PREFERRED EMBODIMENTS

Figure 1:
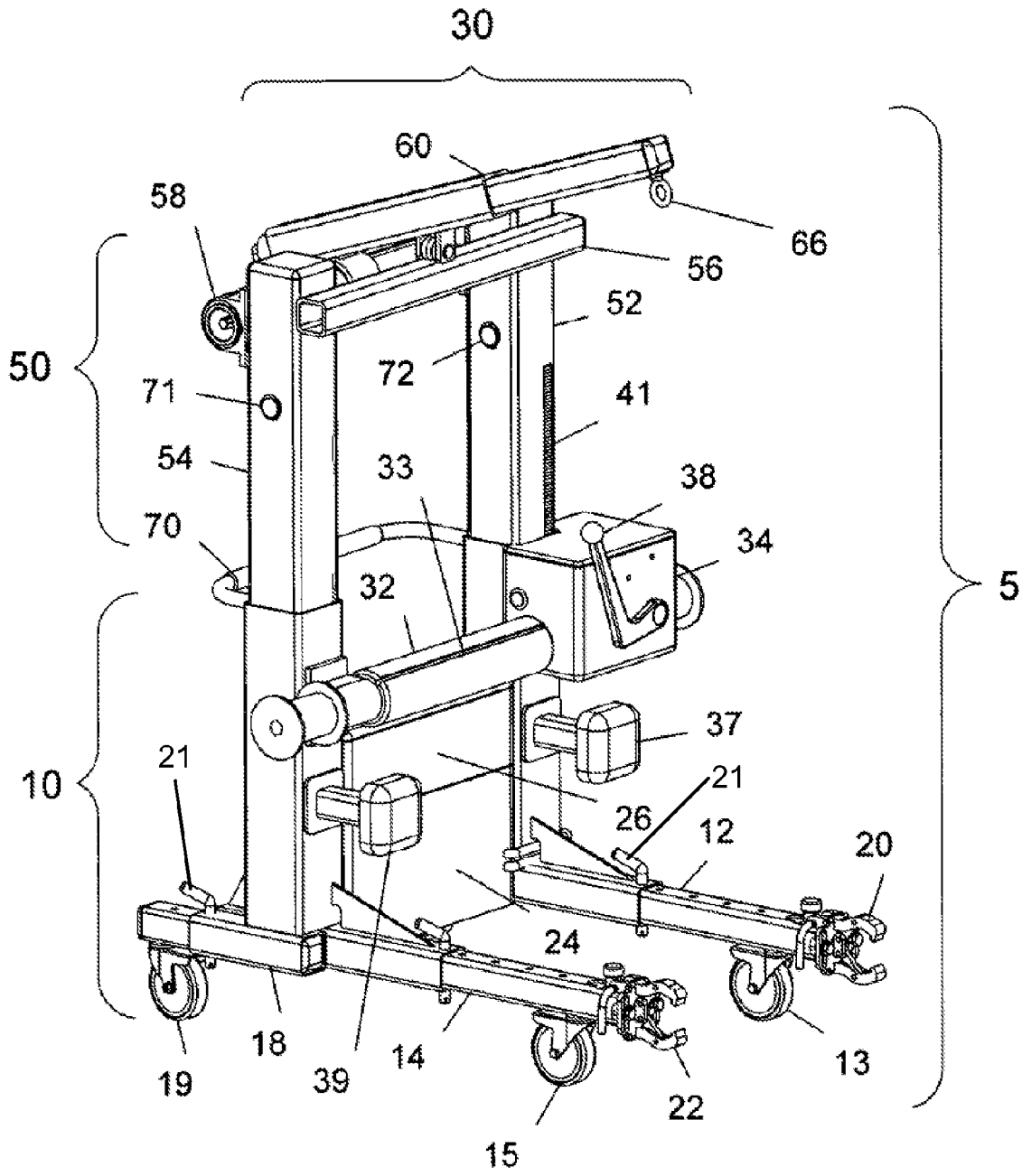
FIG. 1 is a frontal perspective view of the apparatus.

A complete understanding of this invention can be gained through reference to the drawings in conjunction with a thorough review of the disclosure herein. To facilitate this understanding, a table of commonly used reference numerals is provided.

| | |
|---|---|
| 05 | patient mobility appratus |
| 10 | base |
| 12 | first telescoping leg |
| 13 | first wheel |
| 14 | second telescoping leg |
| 15 | second wheel |
| 16 | third telescoping leg |
| 17 | third wheel |
| 18 | fourth telescoping leg |
| 19 | fourth wheel |
| 20 | first clamp |
| 22 | second clamp |
| 23 | fabric gripper |
| 24 | reservoir |
| 25 | fabric sheet |
| 26 | pump |
| 30 | horizontal movement portion |
| 32 | roller |
| 33 | slot |
| 34 | gear box |
| 36 | gears |
| 38 | first crank |
| 40 | hydraulic controller |
| 41 | rack |
| 42 | pinion |
| 50 | vertical movement portion |
| 52 | first vertical telescoping member |
| 53 | first piston |
| 54 | second vertical telescoping member |
| 55 | second piston |
| 56 | horizontal support |

-continued

| | |
|---|---|
| 58 | horizontal track |
| 59 | second crank |
| 60 | telescoping vertical lift member |
| 62 | internal lid screw |
| 64 | third crank |
| 66 | hook |
| 67 | first hollow ring |
| 100 | gurney |

Overview

The apparatus is capable of effectuating patient repositioning and transference both vertically and horizontally without compromising the health and well being of both the patient and caregiver. The apparatus allows a caregiver to single-handedly pull a patient up in a bed, laterally transfer a patient from bed to bed, or roll a patient to their side and maintain that patient position.

The apparatus is mobile and easily transportable by a single caregiver. The apparatus is easily attached and detached to a patient's bed. The apparatus is compact allowing it to be placed between the bed and a wall without consuming significant floor space. Likewise, the apparatus is easily stored without consuming significant storage space.

Figure 2:
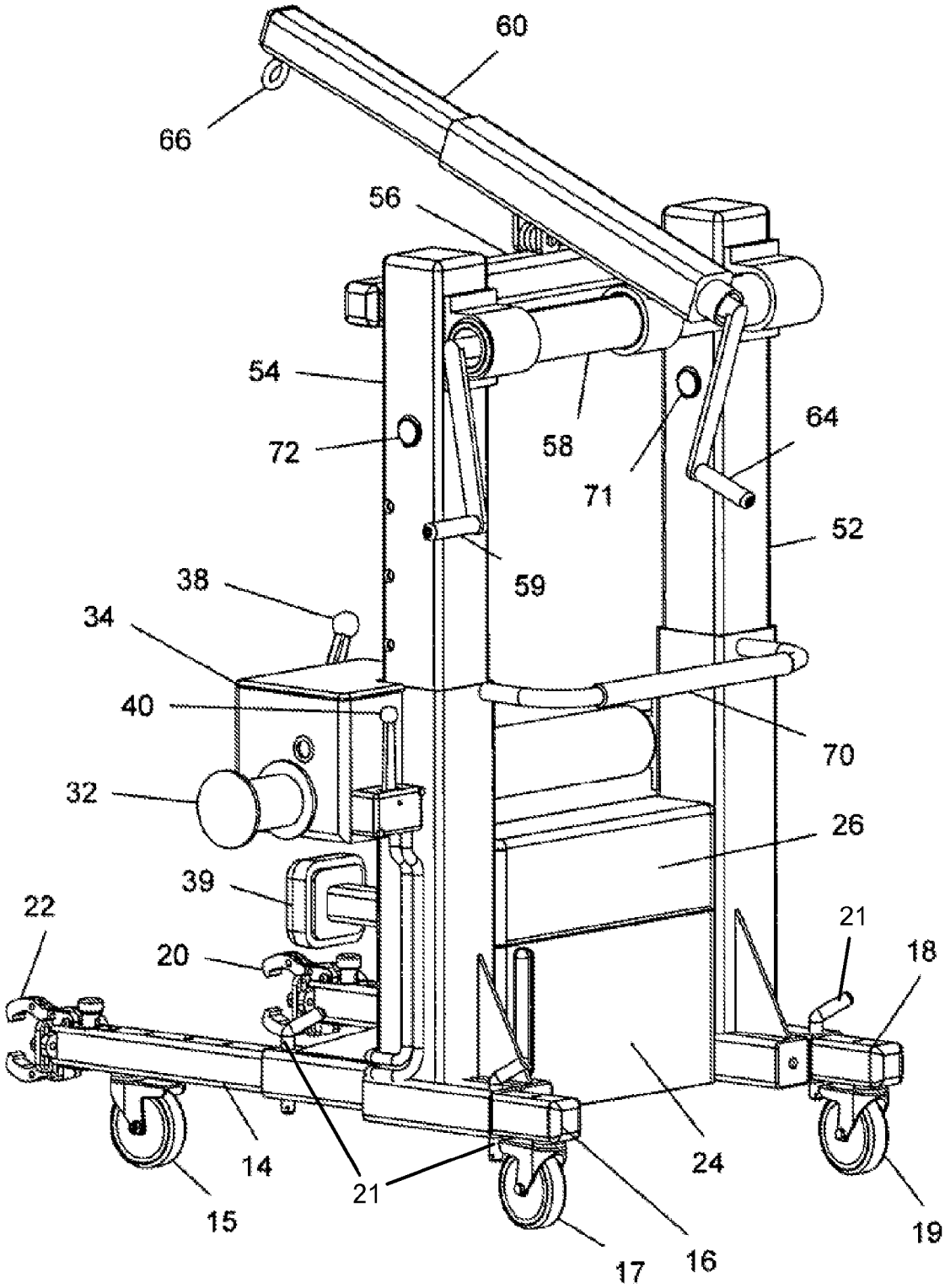
FIG. 2 is a rear perspective view of the apparatus.
Figure 3:
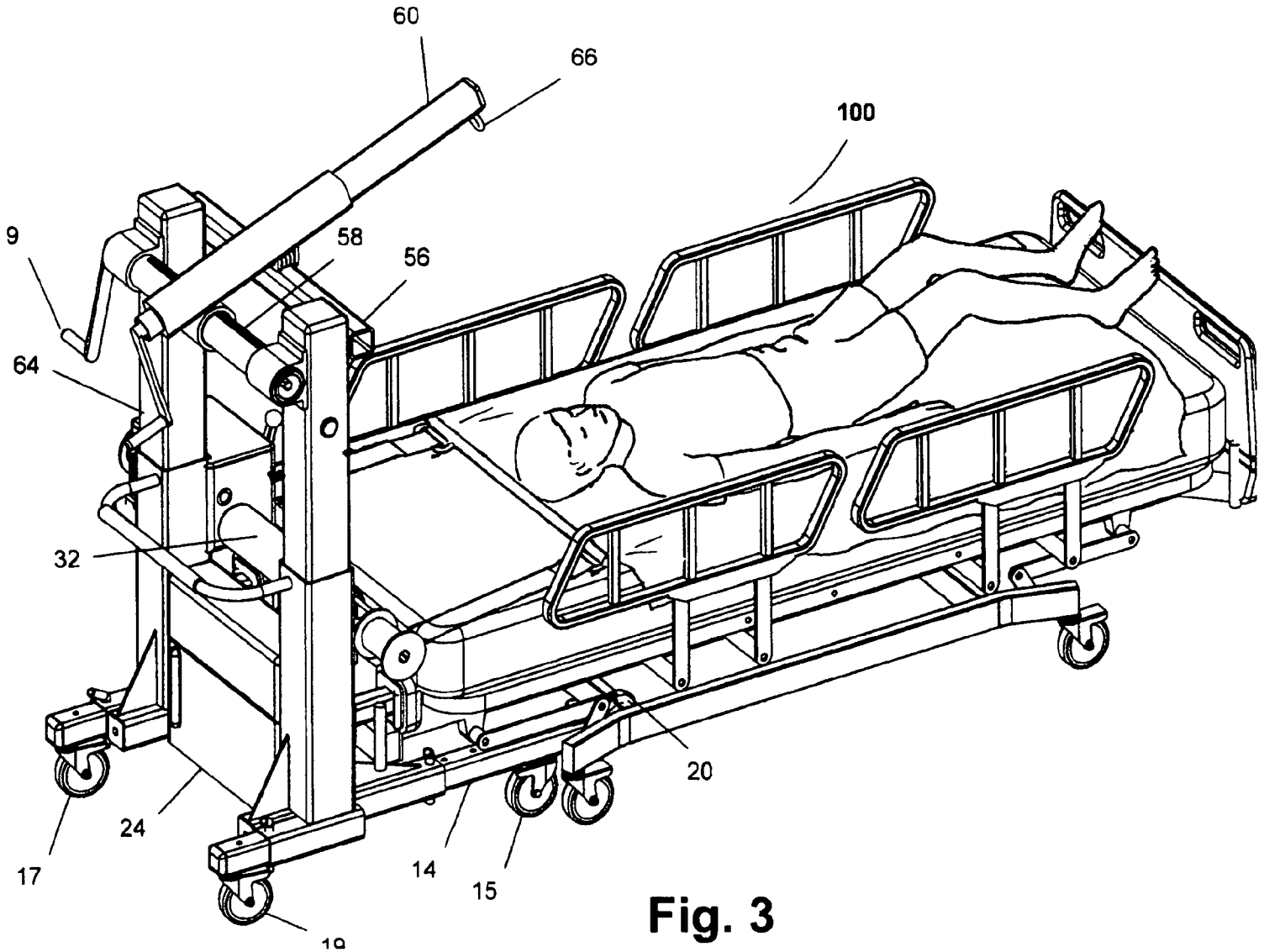
FIG. 3 is an elevated perspective view depicting the apparatus attached to the head of hospital bed positioned for lifting a patient.
Figure 4:
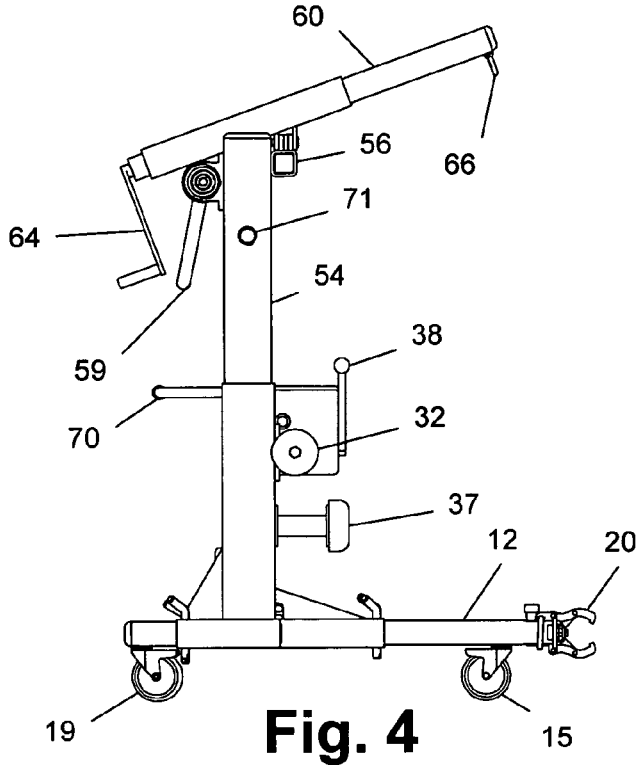
FIG. 4 is a lateral view of the apparatus.
Figure 5:
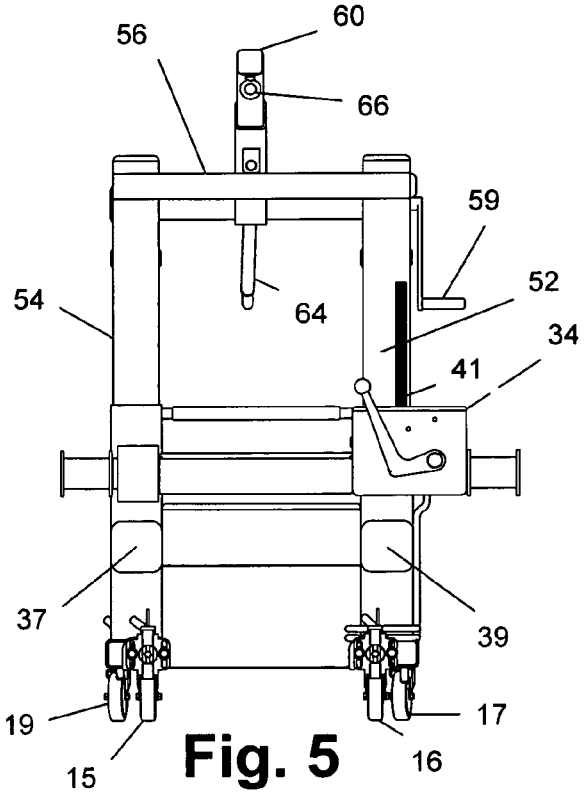
FIG. 5 depicts a front view of the apparatus.
Figure 6:
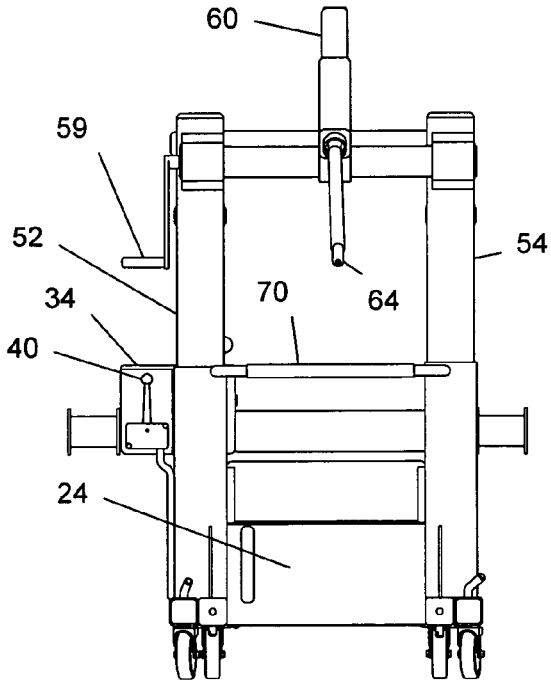
FIG. 6 depicts a rear view of the apparatus.

FIGS. 1 and 2 depict the patient mobility apparatus from a front and rear perspective view, respectively. The apparatus generally comprises four distinct parts: a base 10; a horizontal movement portion 30; vertical movement portion 50; and a lifting arm 60.

Base

A first embodiment of the base portion 10 incorporates one or more legs 12 14 16 18 capable of extending in opposite directions from either the anterior or posterior of the apparatus. It is a preferred embodiment that these horizontal legs telescope, as in FIGS. 1 and 2, thereby allowing them to be retracted when the apparatus is not in use thus minimizing the space necessary to store the apparatus and to account for size differences in beds. Other embodiments readily ascertainable by those in the art are fixed length legs or circular bases. These types of bases are not preferred embodiments however, since they do not allow for adjustments for different size beds and the fixed lengths and circular bases are more difficult to maneuver and store.

A housing portion on the base 23 supports and houses the legs into which the telescoping legs retract. Legs 12 14 16 18 may be either removeably attachable or fixed onto the base. Further, the legs may either extend partially or completely through the base and housing portion. In a preferred embodiment illustrated in FIGS. 1 and 2, there are four telescoping legs that retract into four housing areas contiguously adjoining the base. However, those skilled in the art will readily see that two legs long enough to extend through one housing area on each side opening up to the anterior and posterior of the base can be accomplished with no difficulty and keeping with the overall integrity of the apparatus.

The means for locking the telescoping arms may comprise any number of mechanisms widely known in the art. It is preferred for purposes of simplicity and ease of use, that a locking pin 21 be used to fix the legs in place on either side of the apparatus. The locking pin 21 can be inserted through a hole in the base or a housing portion on the base and through one or more linearly aligned holes in a corresponding leg thereby locking the leg into position at the desired length.

Another exemplary embodiments for extending, retracting, and locking the legs are through the use of a lead screw in the hollow of a leg coupled a shaft and crank on the end of the leg.

The horizontal legs 12 14 16 18 extending from the anterior and posterior of the base also provide a means to counterbalance the apparatus when it is subject to patient loads during patient movement and transference. It is preferred that the legs are in pairs extending from the anterior and posterior of the base to create greater balance and safety.

To secure the apparatus during repositioning, it is also preferred that the outward end of the legs are fitted with a clamp 20 22 to secure the apparatus to the bed during patient movement in order to prevent tipping. It is also preferred that the clamps are easily removable and capable of being installed on each of the legs thereby requiring only one set of interchangeable clamps for both the anterior and posterior legs. However, it can easily be seen by those skilled in the art that a removable clamp can be fitted on the end of each leg.

There are a variety of mechanisms that can be used to clamp the apparatus to the bed. This can be accomplished through a C-clamp; screw clamps; pipe clamps; pressure clamps; or through automatic pressure clamps 20 22 that engages automatically upon touching the frame and disengages by stepping on or applying pressure to a release mechanism.

Another embodiment of the base portion comprises one leg whereby the base portion is fitted with pivoting wheels or castors and where there is one leg that, preferably, telescopes to either the anterior or posterior of the apparatus. It too, has a clamp that can be attached to a standard hospital bed to enable stability of the apparatus during repositioning.

Similar to a multi-leg embodiment, a single leg embodiment can also be one piece capable of being inserted from either side of the base portion. In another variation, the base portion can be machined to form an annular hollow through the base so that a leg can be extended to either side of the apparatus in order to attach to the hospital bed. Similar to the multi-leg embodiment, it is also possible to incorporate a locking pin mechanism that secures the leg through the alignment of holes in the leg and the base.

Horizontal Patient Movement Portion

Figure 10:
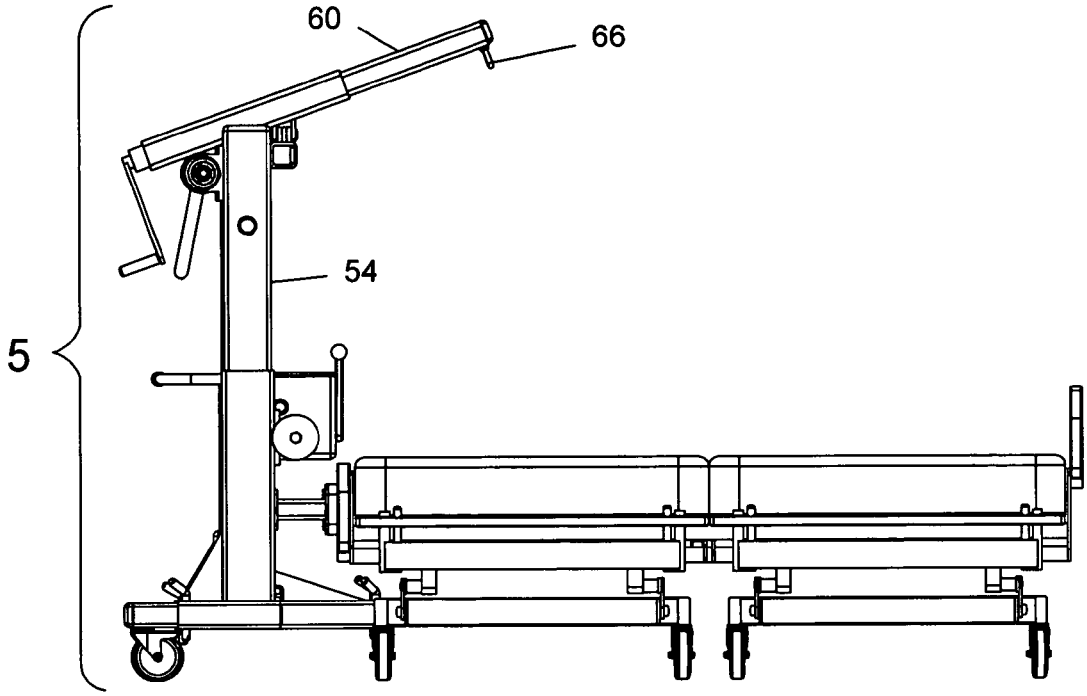
FIG. 10 is a lateral view of the apparatus showing the lifting arm retracted.
Figure 11:
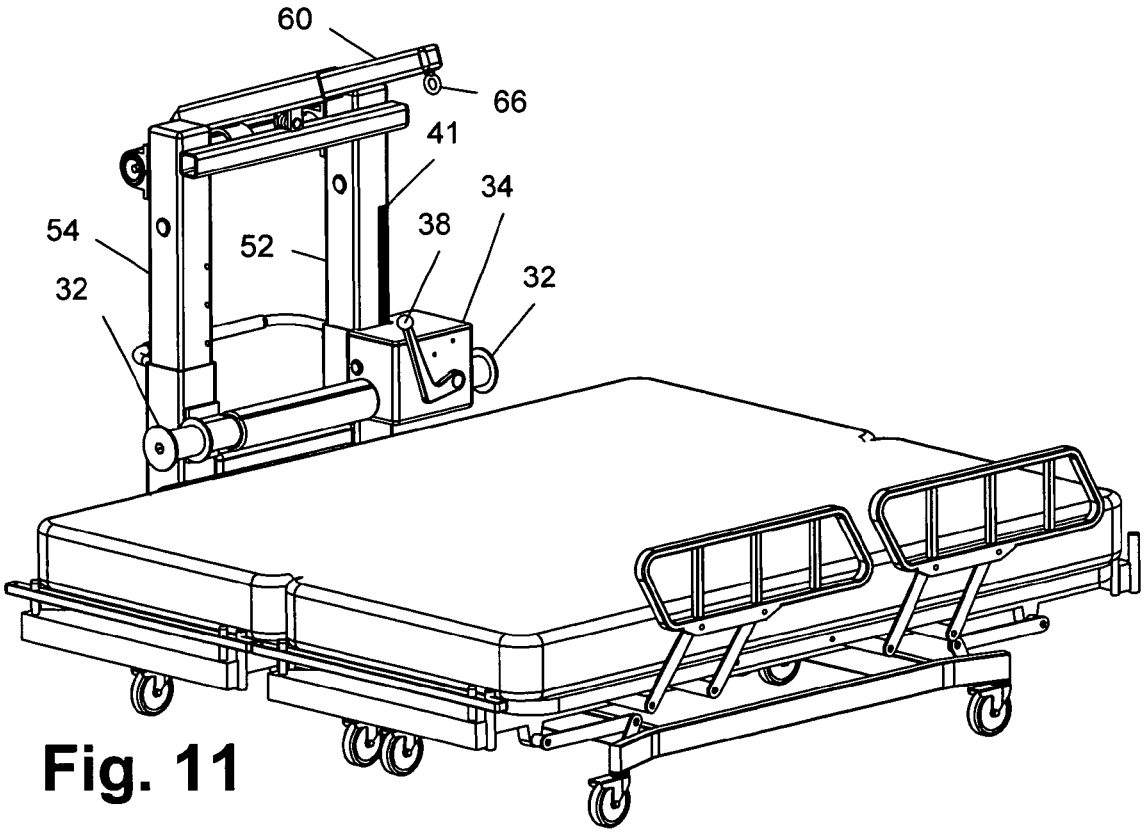
FIG. 11 is a lateral view of the apparatus showing the lifting arm completely out of the way.

A second aspect of the preferred embodiment of the present invention is the ability of the patient mobility system to easily allow a caregiver to move or, in other ways effectuate easy horizontal movement of the patient while they are bedridden. To accomplish this task, a preferred embodiment of the present invention is illustrated in FIGS. 10 and 11 whereby a patient is on a hospital bed lying on a movable piece of sturdy cloth or other flexible material. A caregiver operates a roller assembly (shown in greater mechanical detail in FIGS. 12, 13, and 14) that rolls out one or more belts. On the end of the belts are devices for attaching them to the material on which the patient is lying. In one embodiment, the material could also have a mechanism for fastening to the belts, although it is not the preferred embodiment since it would add additional components separate from the apparatus and thereby increasing costs.

Once the belt(s) are fastened to the material, the operator, via a crank 38, can then slowly move the patient to a desired horizontal position. FIGS. 10 and 11 depict the operational use of the roller and material assembly where a patient is being moved from one hospital bed to another.

Figure 17:
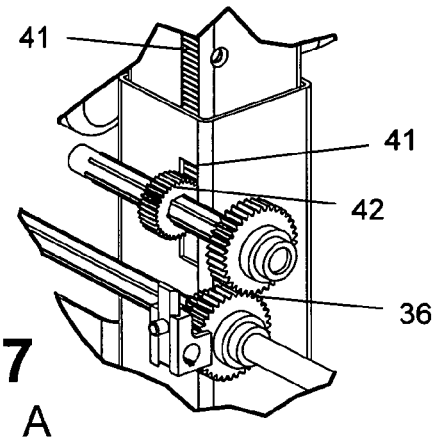
FIG. 17 is an enlarged view of Detail Area A on FIG. 16.
Figure 18:
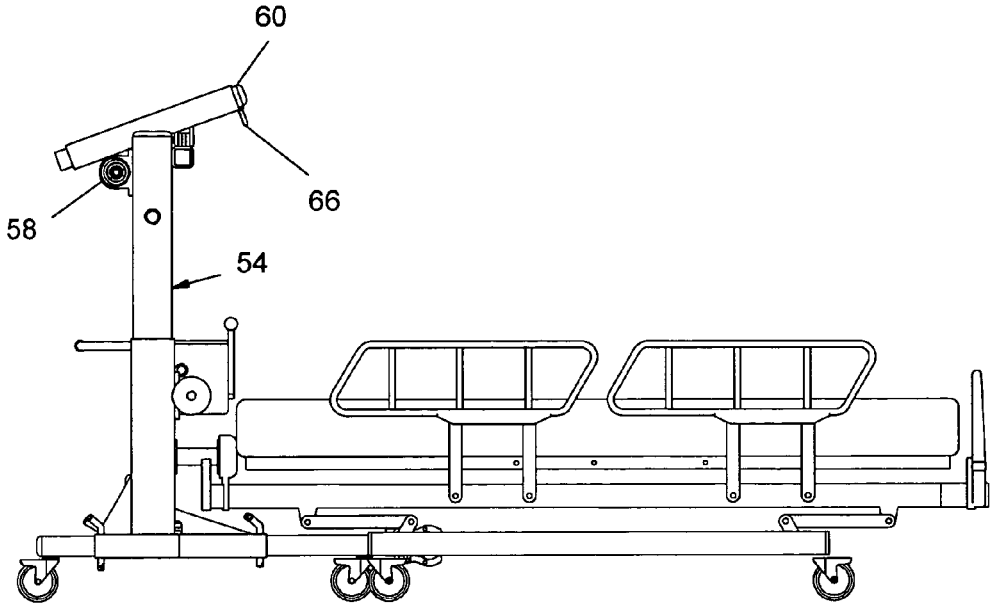
FIG. 18 is an illustration of an exemplary embodiment of an exemplary apparatus.
Figure 19:
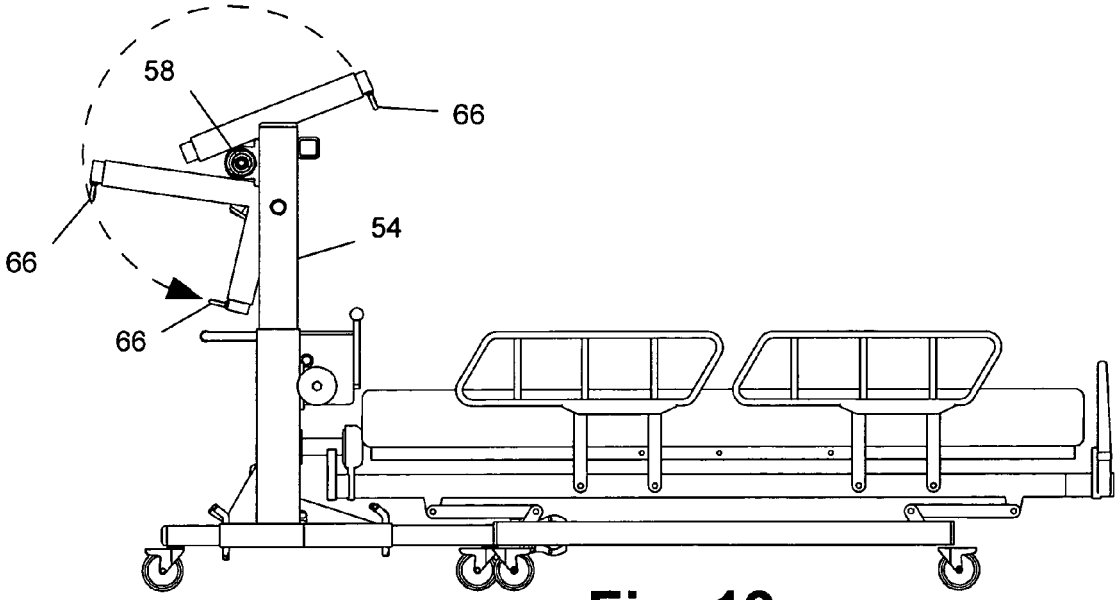
FIG. 19 is an illustration of an exemplary embodiment of an exemplary apparatus.

FIG. 17 shows the basic components of the horizontal movement portion 30 comprising a cylindrical roller 32 with a slot 33 and rolled material capable of being unrolled onto a flat surface such as a bed. For this reason a preferred embodiment positions the roller above the base of the apparatus and at the height of a standard hospital bed. It is preferably set between the first and second vertical lifts 52 54 of the vertical movement portion 50 of the apparatus.

Being positioned between the vertical lifts allows the straps of the roller assembly to engage either side of the present invention. FIG. 8 and 8 show the roller assembly positioned on one side of the entire apparatus although it would be readily ascertained by those in the field of art to position the roller on either side of the apparatus. In fact, there is currently no apparatus available that is able to attach to the head of a bed and pull a patient toward the head of a bed as in FIGS. 3, 7, 10, and 11 which is an all too common necessity when repositioning patients.

Figure 16:
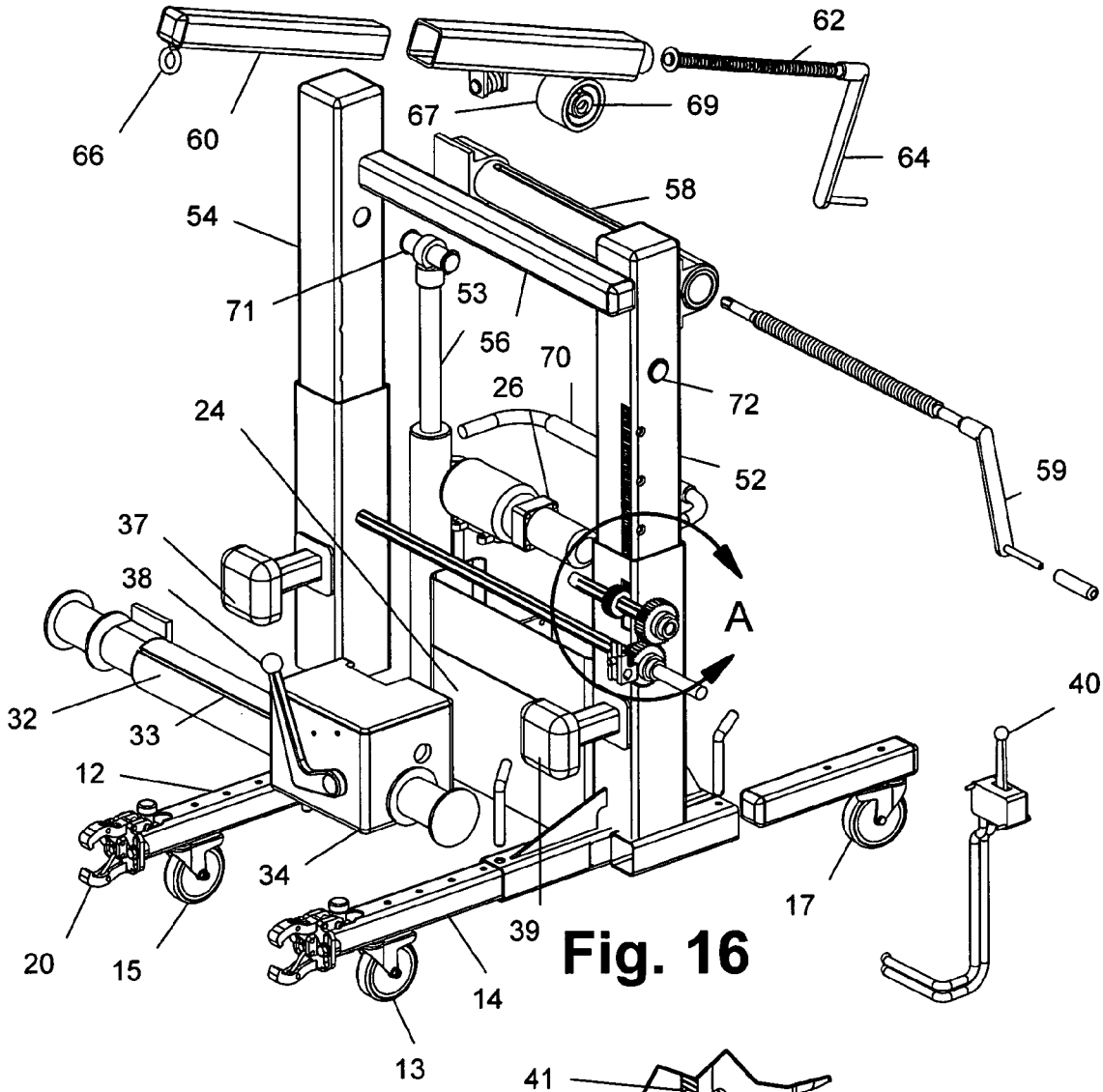
FIG. 16 is an exploded perspective view of the apparatus.

The flexible material around the roller can be tabular or spliced to form two belts or straps oppositely positioned around the roller as is shown in FIG. 16. In order to secure the belts or straps to the roller during movement, a slot 33 can be placed in the roller. The roller 32 is used to pull the patient's bed linens and thereby adjust the patient in the bed. The roller 32 engages the bed linens by the straps or flat material, which may possess a clamping mechanism that attaches to the linens without ripping them. Acceptable clamping mechanisms are disclosed by U.S. Pat. Nos. 5,737,781; and 5,539,941.

Alternatively, the clamps on the material of the roller 32 can reposition a patient using a simple "c"-shaped hook or "j"-shaped hook attached to the end of the straps and the material provided the patient is placed turn sheet as disclosed in U.S. Pat. No. 5,210,887.

In an exemplary embodiment, the horizontal movement is applied by a gears utilized to rotate Roller 32 through a standard gear and gear ratio combination contained in gear box 34 shown in more detail in FIGS. 12 and 13 that serves to roll out the straps or belts. In an exemplary embodiment, a crank is coupled to the roller. In this embodiment, a caregiver actuates a crank connected to a roller gear assembly in gear box 34 that turns the roller based on the motion of the crank where the rotation of the gears is transferred to the roller 32. With control handle or crank you can switch from slow rotation to neutral (no rotation) or fast rotation on the roller 32.

Roller 32 may also be driven either by an electric motor commonly known in the art to effectuate movement of a roller by coupling the motor to a shaft on the roller. Additionally, an electric motor can also have variable speeds to control roller movement.

Vertical Patient Movement Portion

A third aspect of the present invention, as shown in FIGS. 1 and 2 and further detailed in FIG. 14, is to provide a mechanism for vertically positioning the upper portion of the apparatus into an elevated position relative to the person in the bed.

In a preferred embodiment, the base portion 10 incorporates a reservoir 24 for hydraulic fluid and a hydraulic pump 26 for operating a vertical patient movement portion 50. The elevation of the vertical movement is created by one or more vertical lift units 52 54 lifting the upper portion of the apparatus to a desired position through internally mounted pistons 53 55 in the lifts connected to the hydraulic unit as is shown in FIG. 14.

In a preferred embodiment, a hydraulic pump 26, hydraulic controller 40, and pistons 53 55 inside two vertical telescoping members 52 54 create the vertical movement. One or more pistons connected to the hydraulic pump 26 and controller 40, as depicted in FIG. 16, inside each of the vertical telescoping members allows the pump to simultaneously raise both of the telescoping members by the operation of a hydraulic controller 40. In this way, a telescoping lifting arm 60 can be accurately positioned over a person in the hospital bed. It is preferred that the hydraulic pump and cylinder are contained in the base so as to provide proper balance to the apparatus. However, it can be seen that the hydraulic components can be separately joined to the apparatus on areas other than the base.

Alternative embodiments to effectuate the vertical movement of the lifts can be accomplished with the same effect through the use of an electric motor to raise the lifting units by also coupling the electric motor to the base.

In the preferred embodiment illustrated in FIGS. 12 through 16, a rack and pinion mechanism working in tandem with the hydraulic lift creates both the vertical lift and horizontal movement of the roller.

A rack 41 is internally mounted to the innermost portion of one or more of the telescoping lift units 52 54. A pinion 42 is mounted on a short shaft in the gear box 34 proportionately positioned such that its teeth continuously engage the rack while the telescoping lifts are fully retracted, during vertical movement of the lift or, when the lifts, are partially or fully extended. In this way, the rack will rotate the pinion and transfer the rotation of the pinion to the roller. Likewise, the movement of the vertical lift can be actuated by the movement of the roller 32.

In another embodiment, the rotation of the roller can be optimized in order to control the horizontal and vertical movement. In this embodiment, actuation of the horizontal speed is variable, switching from slow rotation, neutral (no rotation) or fast rotation of the roller 32 based on the speed passed to the hydraulic controller by the operator.

Positioning Arm

A fourth aspect of the present invention is to provide a mechanism for lifting a patient out of a bed during vertical lift. This is accomplished through the use of a positioning/lifting arm positioned atop the present invention. FIG. 1 depicts an embodiment of a lifting arm 60 with its use demonstrated in FIG. 7.

FIG. 1 illustrates a preferred embodiment using a telescoping lifting arm 60 controlled by a second crank 64 and internal lead screw 62. At the end of the arm is a hook 66 to which can be attached a mechanism for lifting a patient fully or partially off the bed. Based on the rotation of the second crank 64, the lead screw will thread the arm to extend outward towards and over the bed or to retract it.

Whereas the actuation of second crank 64 adjusts the positioning of the lifting arm outward and over the patient, vertical positioning is created by raising and lowering the hydraulic cylinders, and lateral movement of the lifting arm is provided by a third crank and lead screw assembly 59 inside a slotted cylinder 58 attached to the lifting arm as is depicted in FIG. 16. In this embodiment, the lifting arm is coupled to the slotted cylinder by means of a first threaded hollow ring with a protruding lip 67 that fits over the slotted cylinder. Attached to the lifting arm is a second hollow ring with a slot 68 capable of securely receiving the lip. In this way, the movement of the rotation of the lead screw creates a lateral movement of the lifting arm through a clockwise or counterclockwise rotation of the crank.

Figure 7:
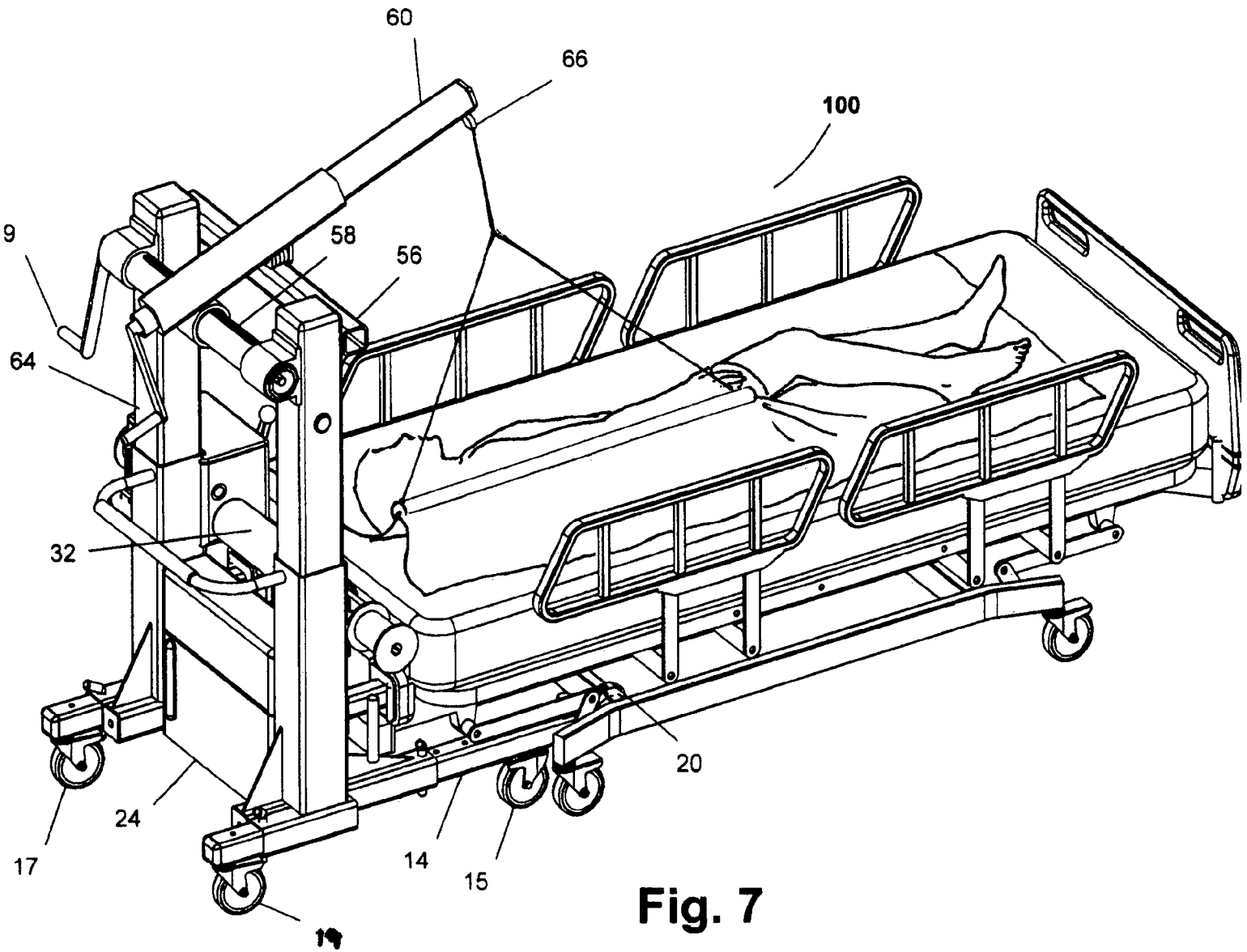
FIG. 7 is a perspective view of the apparatus attached to the head of the bed turning a patient side to side in a bed.
Figure 8:
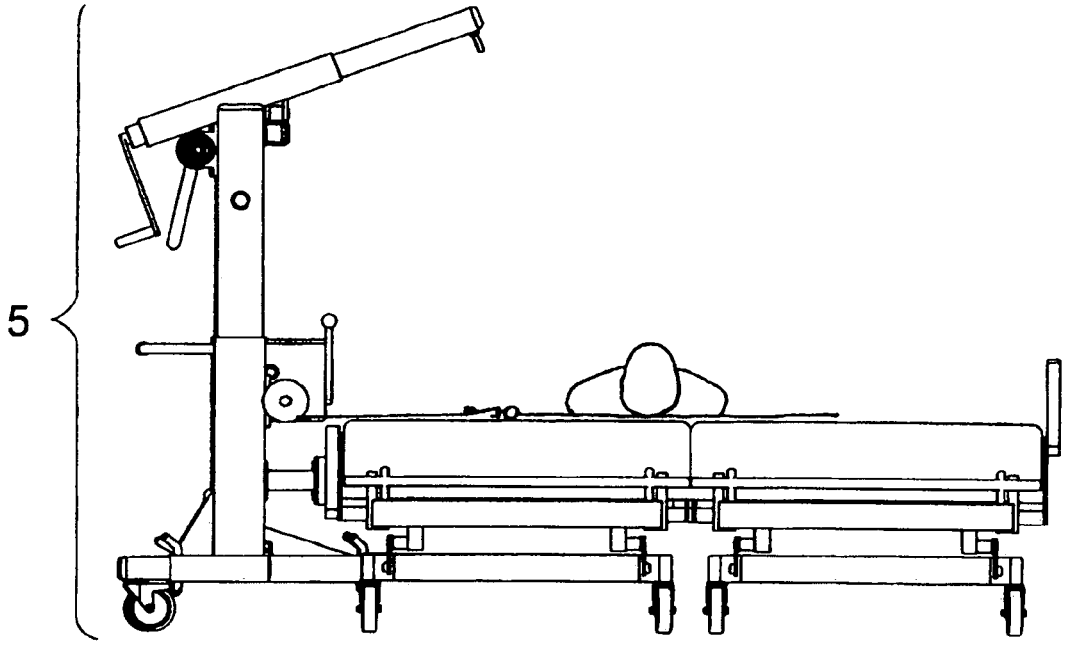
FIG. 8 is a lateral view of the apparatus attached to the lateral side of a hospital bed in order to pull a patient (not shown) from one hospital bed onto a second hospital bed connected to the apparatus.
Figure 9:
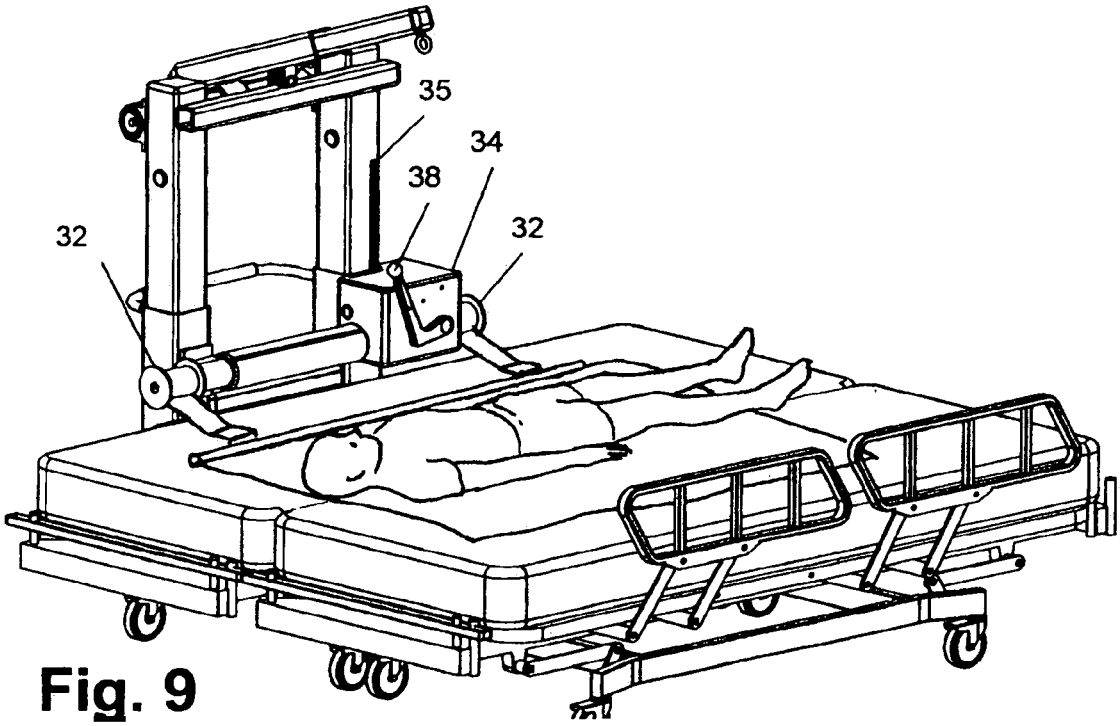
FIG. 9 is a perspective view of the apparatus attached to the lateral side of a hospital bed in order to pull a patient (not shown) from one hospital bed onto a second hospital bed connected to the apparatus.

FIG. 7 depicts how patient movement might occur. In an exemplary embodiment, the arm 60 is attached to a fabric gripper, which is attached to a fabric sheet under the patient. The machine is operated vertically, lifting one side of the sheet under the patient. Then, a pillow can be placed under the patient and everything is lowered.

The mechanism for lifting the patient with the arm is varied and there are many suitable methods commonly known and available in the art such as a high test cable with clamps for attaching to the fastening ring 66 and the fabric under the patient or other similar method.

In another embodiment, the lifting of the patient is effected through a hook, mat, and string assembly where a mat has fastening mechanisms or rings attached to its sides that are fastened to a string or cable capable of supporting the full or partial weight of a patient in a bed. In this way, the caregiver can move a patient by first, positioning the lifting arm above the patient, fastening the string or cable assembly to the hook and mat and then lifting the patient with the vertical patient movement.

In order to ensure that the positioning arm of the apparatus does not interfere with medical care, an exemplary embodiment is to have the positioning arm 60 rotate to an upright or a position opposite the upright position. FIG. 10 depicts the positioning arm 60 in its upright position and ready for use. FIG. 11 illustrates the positioning arm in its retracted position. To rotate the arm to an upright or retracted position, it will be lifted manually.

CONCLUSION, RAMIFICATIONS, AND SCOPE

While the above description contains many specificities, these should not be construed as limitations on the scope of the invention, but as exemplifications of the presently preferred embodiments thereof. Many other ramifications and variations are possible within the teaching of the invention.

Thus the scope of the invention should be determined by the appended claims and their legal equivalents, and not solely by the examples given.

The invention claimed is:

1. A patient mobility apparatus for repositioning a person in a bed comprising:

a base;

a vertical movement portion extending upwards from said base with means for lifting the vertical movement portion;

a horizontal movement portion coupled to said base and vertical movement portion with means for moving a person horizontally in a bed; and a lifting portion situated on top of the apparatus with means for lifting a person in a bed.

2. The patient mobility system of claim 1 wherein:

said base further comprises at least one leg extending outward from said base and means for moving said apparatus;

said vertical movement portion comprises a first and second side;

said horizontal movement portion is situated between said first and second side of said vertical movement portion; and said lifting portion comprises a lifting arm.

3. The patient mobility system of claim 1 wherein:

said base further comprises two telescoping legs extending outward from a front and back of the apparatus, wheels for moving the apparatus, and means for removeably securing the apparatus to a bed;

said vertical movement portion comprises two vertical lifts extending upwards from said base;

said horizontal movement portion is situated between said vertical movement portion; and said lifting portion further comprises a lifting arm.

4. The patient mobility system of claim 1 wherein:

said base further comprises two telescoping horizontal legs extending outward from the anterior and posterior of the apparatus, castors coupled to the legs for movement, linearly aligned holes in the base and legs, and a removable locking pin capable of being simultaneously inserted and removed from any one of the holes in the leg and the base;

said vertical movement portion comprises two vertical lifts extending upwards from said base; and said lifting portion comprises a lifting arm.

5. A patient mobility apparatus for repositioning a person in a bed comprising:

a base comprising at least one leg extending outward from said base with means for moving said apparatus;

a vertical movement portion comprising two vertical lifts extending upwards from said base with means for lifting said vertical movement portion, and a first and second side;

a horizontal movement portion situated between said first and second side of the vertical movement portion and further comprising a roller and belt with means for actuating the roller and single belt; and a lifting portion comprising a lifting arm with means for lifting or repositioning a person in a bed.

6. The patient mobility apparatus of claim 5 wherein:

said base portion comprises at least two telescoping horizontal legs extending outward from said base;

said means for moving said apparatus are castors;

said means for actuating the roller is a crank and gear assembly; and each leg comprises a detachable portion and means for removeably attaching to the bed.

7. The patient mobility apparatus of claim 5 wherein said means for actuating the roller and belt is a variable speed electric motor.

8. The patient mobility apparatus of claim 5 wherein said means for actuating the roller and belt is a hydraulic pump.

9. A patient mobility apparatus for repositioning a person in a bed comprising:

a base comprising at least one leg extending outward from said base with means for moving said apparatus;

a vertical movement portion comprising first and second vertical lifting units extending upwards from said base with drive force means for lifting said units;

a horizontal movement portion situated between the first and second vertical lifting units and further comprising a roller, a first and second belt, and means for actuating the roller and belts to effectuate horizontal movement of a person in the bed; and a lifting portion comprising means for lifting a person in a bed.

10. The patient mobility apparatus of claim 9 wherein:

said base further comprises a hydraulic pump;

said first and second lifting units are hollow and telescope upwards from the base;

said vertical patient movement portion further comprises a first and second piston coupled to the inside of the first and second lifting units, respectively;

a hydraulic controller is coupled to the apparatus with means for controlling the actuation of the hydraulic pump and the upward and downward movement of the pistons; and said lifting portion comprises a lifting arm.

11. A patient mobility apparatus for repositioning a person in a bed comprising:

a base with means for moving said apparatus;

a vertical movement portion extending upwards from said base portion with means for lifting the vertical movement portion;

a horizontal movement portion coupled to said base and vertical movement portion with means for moving a person horizontally in a bed; and a telescoping lifting arm situated on top of the apparatus with means for lifting or repositioning a person in a bed.

12. The patient mobility system of claim 11 wherein the lifting arm further comprises linearly aligned holes and a removable licking pin capable of being inserted and removed from any one of the holes in the arm.

13. The patient mobility system of claim 11 wherein the lifting arm further comprises an internal lead screw and a crank capable of extending and retracting the lifting arm in order to position it over the person in a bed.

14. The patient mobility system of claim 11 wherein a lateral movement portion is coupled to the top of the vertical movement portion and said lifting arm, with means for moving the lifting arm laterally.

15. The patient mobility system of claim 14 wherein:

the means for moving the lifting arm laterally comprises a slotted hollow cylinder with a lead screw and a threaded first annular ring with a lip;

the lifting arm further comprises a slotted second annular ring capable of fitting around the slotted hollow cylinder and of receiving the lip; and the second annular ring is coupled to the lifting arm.

16. A patient mobility apparatus for repositioning a person in a bed comprising:

a base portion comprising at least two telescoping legs extending outward from said base with means for moving said apparatus;

a vertical movement portion comprising a first and second telescoping vertical lifting units extending upwards from said base with drive force means for lifting said units and a rack mounted vertically in the hollow of one of the lifting units;

a horizontal movement portion situated between said vertical movement portion comprising a roller with a first and second belt, a gear and crank combination coupled to the roller and further engaging a pinion that continuously engages said rack; and a lifting portion comprising means for lifting a person in a bed.

17. The patient mobility apparatus of claim 16 wherein:

said means for moving said apparatus comprises castors coupled to each leg;

detachable clamps are affixed to the end of each leg and are also capable of removeably attaching to a bed in order to secure the apparatus during patient repositioning;

first and second pistons are coupled to the inside of each of the first and second lifting units, respectively;

said means for lifting said units comprises a hydraulic pump coupled to said base wherein a hydraulic controller is coupled to the apparatus with means for controlling the actuation of the hydraulic pump and the upward and downward movement of the pistons;

said lifting means comprises a telescopic lifting arm with a lead screw and a crank for extending and retracting said lifting arm;

a lateral movement portion is coupled to the top of the vertical movement portion and said lifting arm;

said lateral movement portion further comprises a slotted hollow cylinder with a lead screw and a threaded first annular ring with a lip;

said lifting arm further comprises a slotted second annular ring capable of fitting around the slotted hollow cylinder and of receiving the lip;

the second annular ring is coupled to the lifting arm; and said lifting arm comprises means for retracting, or protracting to an upright position.

* * * * *